United States Patent [19]

Andrich et al.

[11] 4,147,815

[45] Apr. 3, 1979

[54] METHOD OF COATING THE INNER SURFACE OF A DISPLAY WINDOW OF A TELEVISION DISPLAY TUBE TO FORM A DISPLAY SCREEN

[75] Inventors: Ekkehard Andrich, Hergenrath; Klaus Schlageter, Aachen, both of Fed. Rep. of Germany

[73] Assignee: U.S. Philips Corporation, New York, N.Y.

[21] Appl. No.: 831,166

[22] Filed: Sep. 7, 1977

[30] Foreign Application Priority Data

Sep. 17, 1976 [DE] Fed. Rep. of Germany ..... 2641868

[51] Int. Cl.[2] ..... B05D 1/40; B05D 1/02

[52] U.S. Cl. ..... 427/64; 239/220; 427/68; 427/236; 427/240; 427/421

[58] Field of Search ..... 427/64, 68, 233, 236, 427/421, 240; 239/220

[56] References Cited

U.S. PATENT DOCUMENTS

| | | | |
|---|---|---|---|
| 1,520,446 | 12/1924 | Satake | 239/220 |
| 2,987,415 | 6/1961 | Taggett | 427/64 |
| 4,035,524 | 7/1977 | Fritsch | 427/240 X |
| 4,052,519 | 10/1977 | Prazak | 427/233 X |

*Primary Examiner*—James R. Hoffman

*Attorney, Agent, or Firm*—Algy Tamoshunas

[57] ABSTRACT

A method for coating with a liquid the window panel of a display tube by means of at least one brush mounted for rotaton in a reservoir containing the liquid. As the partially submerged brush is rotated about its axis, drops of liquid picked up by the brush hairs are flung against the window panel. This method results in continuous mixing of the coating material and the return of the excess coating liquid back into the reservoir so that losses of the coating material are minimized.

4 Claims, 3 Drawing Figures

METHOD OF COATING THE INNER SURFACE OF A DISPLAY WINDOW OF A TELEVISION DISPLAY TUBE TO FORM A DISPLAY SCREEN

The invention relates to a method of coating the inner surface of a display window of a television display tube to form a display screen, in which the material necessary for the coating is provided in a liquid form on the display window.

Various methods are known for the manufacture of a display screen of a colour television display tube.

In one such method, phosphor particles suspended in a liquid are caused to flow from above into the display window mounted at an angle on a correspondingly constructed support device. As the liquid flows over the display window, the window is rotated about its axis and shortly before the end of the flow, the speed of rotation is increased producing a coating which is sufficiently uniform on the inner surface of the display window. Excess liquid and suspension with sediments is received at the corners of the display window by special receivers and from there returned to receiving reservoirs. The very expensive phosphors are recovered from this liquid, while the carrier emulsions which cannot be reused are drained.

In addition to wet-chemical coating methods, electrophotographic methods are also known in which the inner surface of the display window is coated with a photoconductive layer. It is also known, for example from French Pat. Nos. 1,588,531 and 1,602,204, to temporarily spray, during the coating process, the inner surface of the display window from below through a nozzle which is suitably moved towards the screen.

In the first-mentioned method, the flow rate and the speed of rotation of the display window must be very accurately matched to each other in order to obtain uniform layer thicknesses, because the phosphors suspended in the liquid start to settle as soon as the liquid lands on the inner surface of the display window, so that different layer thicknesses tend to be obtained which, give rise to different light intensities at various places on the display screen.

One drawback of the coating methods disclosed in the above cited French Pat. No. is that the spraying has to be interrupted when the display screen is shifted. Since the coating agents, for example, when the electrophotographic method is used, the developer suspension, dry readily, the nozzles very rapidly clogged during the above-mentioned shifting time.

It is the object of the invention to avoid these important drawbacks and to provide a method which can produce a sufficiently uniform coating on the inner surface of the display windows, and in which, also, excess liquid is returned simultaneously and directly to the useful liquid and is readily mixed again with the starting liquid.

U.S. Pat. No. 1,520,446 relates to a laundry sprayer and discloses a rotatable brush co-operable with an interned edge of a housing. The relevant hairs of the brush which are directed downwards are dipped in the liquid and when encountering the interned edge the brush hairs are first restrained and then allowed to spring forward so as to spray the laundry.

In a method of the kind mentioned in the first paragraph, the object according to the invention is achieved in that, by means of a brush which is provided in a reservoir containing the liquid and being covered on the upper side by the display window to be coated, and which brush is provided on a shaft, so as to be rotatable and adjustable in such manner that its relevant downwardly projecting brush hairs are dipped in the liquid, drops of liquid are taken along by the brush hairs by rotating the brush and are flung away.

In a preferred embodiment of the invention an edge member is provided on one side of the reservoir approximately at the level of the upper side of the shaft of the brush, so that brush hairs strike the edge member and are flicked past it and drops are flung against the display window. Alternatively, two brushes driven in opposite directions may be arranged in the reservoir. Of the two brushes, the one which is driven more slowly has its hairs dipping in the liquid and flings liquid onto the other brush which is driven at a higher speed and which flings drops of liquid against the display window. The brushes may be constructed as rollers.

When using the invention the depth to which the brush hairs are immersed in the liquid can be adjusted by adjusting the height of the shaft. When, however, only one brush and one brush roller, respectively, is used, it is found that the liquid at the required number of revolutions is taken along in the direction of rotation of the brush and is consequently thrown up periodically more or less at the edge of the window panel. An improvement in this respect is obtained by providing an edge member co-operating with the brush. This ensures that the brush hairs are obstructed and then leave the rake at a higher speed so that the drops are flung away at a much higher speed. As a result, the size of the drops is also reduced so that a better or finer coating is obtained. A further improvement is obtained, finally, when two brushes driven in opposite directions are provided in the reservoir and only the brush driven at lower speed is dipped in the liquid. This latter brush then transports the drops to the brush driven at higher speed and the latter throws and flings, respectively, the drops towards the inner surface of the display screen.

The resulting layers are of improved uniformity. The excess liquid may drain and flow back into the reservoir itself. Since the hairs of the brush are always dipped in and take along fresh drops from the liquid, good mixing of the liquid is obtained obviating the need for the recovering devices required in the prior art. By means of a simple device it can be achieved that the level of the liquid in the reservoir is always at the same level.

The liquid which is processed in the reservoir depends on the method. Thus it is possible to fling developer suspensions which are necessary for electrophotographic methods, as well as liquids in which phosphor suspensions, also for electrophotographic methods, are present. However, liquids may also be used which are used for the so-called conventional wet-chemical method. The speeds of rotation of the brush or brushes is adjusted in accordance with the viscosity of the liquid and/or the sedimentation in the liquid.

The invention will now be described in greater detail with reference to the accompanying drawing, in which:

FIG. 1 shows a display window 1 of a colour television display tube whose inner surface 2 is to be coated.

Figure 1:
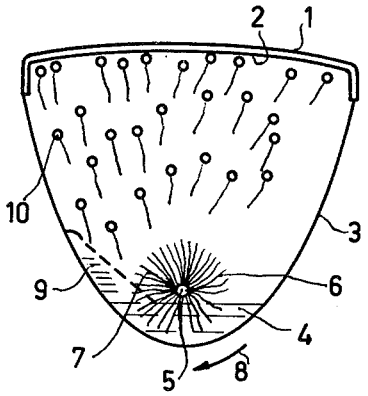
FIG. 1 is a sectional view of a reservoir containing a liquid and a rotary brush.

For that purpose, the display window 1 is laid on the open top of a reservoir 3 of liquid 4 of which only the inner wall is shown diagrammatically. A rotary brush 6 having radially extending hairs 7 is mounted on a shaft 5 not shown. When the brush roller 6 is rotated in the direction of the arrow 8, the liquid 4, as indicated at 9, is driven upwardly along the wall of the reservoir and finally drops again as a result of gravity, so that at that area the liquid undulates. At the same time, individual drops 10, which are withdrawn from the liquid, are thrown against the inner surface 2 of the display window 1 and the excess liquid flows outwardly and downwardly over the inner surface.

Figure 2:
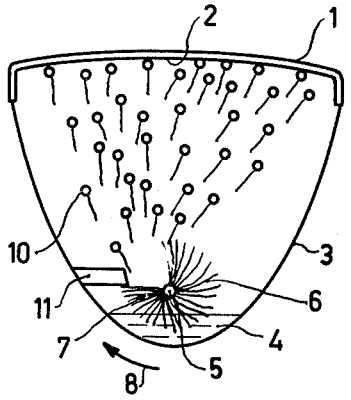
FIG. 2 is the same sectional view of a device as shown in FIG. 1 having in addition an edge member.

FIG. 2 shows an improvement in which an edge member 11 is added on one side of the wall of the reservoir 3. The brush hairs strike the edge member and flick past it, so that the drops 10 reach a higher speed and also reach the inner surface 2 of the display window in a more finely divided manner.

Figure 3:
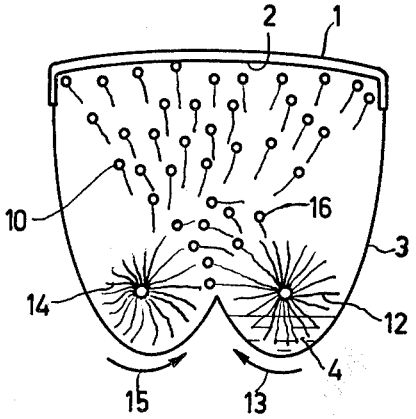
FIG. 3 shows the same sectional view of a device as shown in FIGS. 1 and 2 and having two rotary brushes.

FIG. 3 shows a further improvement with respect to the uniform distribution of the drops over the whole inner surface 2 of the display window 1. In this embodiment two cylindrical rotary brushes are provided in the reservoir 3 in a manner such that one brush 12 rotate to the right, as denoted by the arrow 13, and the other brush 14 rotates to the left, as denoted by the arrow 15. When the brush 12 rotates, it takes along drops from the liquid 4 and, as denoted at 16, throws them on the other brush 14. Brush 14 rotates at a considerably higher speed and then throws the drops 10 against the inner surface 2 of the display window 1. The catch brush 12 rotates at approximately 60 to 250 rpm and the other roller 14 rotates at 1000 rpm.

In all cases the excess liquid is immediately recovered and can be used again directly. This is also possible in the embodiment of FIG. 3 if, for example, the reservoir for the liquid 4 is made slightly deeper than that below the brush roller 14.

What is claimed is:

1. In the manufacture of a display screen for a television display tube, the method of coating, with a liquid, a window panel of the display tube, said method comprising the steps of positioning the window panel to be coated above a vessel containing said liquid, positioning a brush having a central axis and radially extending brush hairs in said vessel at a position such that said axis is generally parallel to the surface of the liquid and the brush hairs on one side of said axis are at least partially immersed in said liquid, and rotating said brush about said axis at a rate sufficient to fling onto the window panel drops of liquid picked up by the brush hairs as they pass through the liquid.

2. The method according to claim 1 including the step of mounting in said vessel a member having an edge extending generally parallel to and spaced from said axis at a distance such that said brush hairs strike and are flicked past said edge during rotation of said brush.

3. The method according to claim 2 wherein said brush is cylindrical.

4. In the manufacture of a display screen for a television display tube, the method of coating with a liquid a window panel of the display tube, said method comprising the steps of positioning the window panel to be coated above a vessel containing said liquid, positioning a brush having a central axis and radially extending brush hairs in said vessel at a position such that said axis is generally parallel to the surface of the liquid and the brush hairs on one side of said axis are at least partially immersed in said liquid, positioning a second brush having a central axis and radially extending brush hairs in said vessel at a position such that the brush hairs thereof are not in direct contact with said liquid and the axis thereof is generally parallel to the axis of said first brush, and rotating said brushes at different speeds in opposite directions, said first brush being rotated at a lower speed so that drops of liquid picked up by the brush hairs as they pass through the liquid during rotation are flung onto said second brush which is rotated at a speed sufficient to fling said drops onto the window panel.

* * * * *